US005777287A

United States Patent [19]

Mayo

[11] Patent Number: 5,777,287

[45] Date of Patent: Jul. 7, 1998

[54] AXIAL MAGNETIC FIELD COIL FOR VACUUM INTERRUPTER

[75] Inventor: Stephen D. Mayo, Horseheads, N.Y.

[73] Assignee: Eaton Corporation, Cleveland, Ohio

[21] Appl. No.: 769,810

[22] Filed: Dec. 19, 1996

[51] Int. Cl.[6] ..... H01H 33/66

[52] U.S. Cl. ..... 218/123; 218/124; 218/127; 218/129; 200/275

[58] Field of Search ..... 218/123–129, 218/146; 200/275

[56] References Cited

U.S. PATENT DOCUMENTS

| | | | |
|---|---|---|---|
| 3,823,287 | 7/1974 | Bettge . | |
| 3,836,740 | 9/1974 | Hundstad | 218/125 |
| 4,260,864 | 4/1981 | Wayland et al. . | |
| 4,295,021 | 10/1981 | Asinovsky et al. | 218/127 |
| 4,324,960 | 4/1982 | Aoki | 218/125 |
| 4,334,133 | 6/1982 | Gebel et al. | 218/129 |
| 4,584,445 | 4/1986 | Kashiwagi et al. | 218/123 |
| 4,588,879 | 5/1986 | Noda et al. . | |
| 4,675,483 | 6/1987 | Gebel et al. . | |
| 4,704,506 | 11/1987 | Kurosawa et al. . | |
| 4,871,888 | 10/1989 | Bestel . | |
| 4,982,059 | 1/1991 | Bestel . | |
| 5,055,639 | 10/1991 | Schels et al. . | |
| 5,313,030 | 5/1994 | Kusserow et al. . | |
| 5,438,174 | 8/1995 | Slade . | |

OTHER PUBLICATIONS

Slade, "The Vacuum Interrupter Contact", *IEEE Transactions on Components, Hybrids, and Manufacturing Technology*, vol. CHMT-7, No. 1 (Mar. 1984).

*Primary Examiner*—Khanh Dang
*Attorney, Agent, or Firm*—Martin J. Moran

[57] ABSTRACT

An electrode assembly for a vacuum interrupter is disclosed having a coil structure that produces an axial magnetic field during operation of the assembly. The electrode coil includes at least one arcuate arm having a radial cross section which provides more material adjacent to a base of the coil than adjacent to a contact plate of the assembly. In a preferred embodiment, the cross sectional area of the arcuate arm has a trapezoidal shape. The electrode assembly provides improved heat transfer during operation of the vacuum interrupter while maintaining a sufficient axial magnetic field. As a result, the electrode assembly may be operated at higher continuous currents than conventional designs.

23 Claims, 3 Drawing Sheets

AXIAL MAGNETIC FIELD COIL FOR VACUUM INTERRUPTER

FIELD OF THE INVENTION

The present invention relates to vacuum interrupters, and more particularly relates to improved axial magnetic field coils for vacuum interrupters.

BACKGROUND INFORMATION

Vacuum interrupters are typically used to interrupt AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit.

An arc is typically formed between the contact surfaces when the contacts are moved apart to the open circuit position. The arcing continues until the current is interrupted. Metal from the contacts that is vaporized by the arc forms a neutral plasma during arcing and condenses back onto the contacts and also onto vapor shields placed between the contact assemblies and the vacuum envelope after the current is extinguished.

The arc generally is initially in a compact, columnar form that creates a hot plasma. A hot plasma can support a significant current between the contacts, and therefore make the current more difficult to interrupt. It is advantageous to encourage the columnar arc to become a diffuse arc, leading to a cooler plasma and a more easily interrupted current. A diffuse arc, because it distributes the arc energy over a broader area of the contact surface, does not vaporize as much of the contact as does a columnar arc, and thereby extends the useful life of the contacts and the interrupter.

One technique of encouraging formation of a diffuse arc is by imposing an axially directed magnetic field in the region between the contacts. The field can be self generated by the interrupter current in coils located behind each contact. A variety of electrode assemblies incorporating such coils for axial magnetic field vacuum interrupters are discussed in the article entitled "The Vacuum Interrupter Contact" by Paul Slade, *IEEE Trans. on Components, Hybrids, and Mfg. Tech.*, Vol. CHMT-7, No. 1, March 1987.

Prior art field coils, such as the coils disclosed in U.S. Pat. Nos. 4,260,864, 4,588,879 and 5,055,639 typically include current carrying arms radiating from a central hub, the radial arms connecting to arcuate coil elements. The radial arms generate fields having a significant component that is not in the axial direction. The non-axial fields can perturb the arc and delay transition of the arc to the diffuse state. In addition, the radial arms add significantly to the total length of the current path. This adds a resistive heat load to the interrupter that may have to be compensated for by unwanted design modifications. The non-axial fields produced by current carrying elements other than the arcuate coil elements can also create eddy currents in the contacts which create fields opposing the axial field, reducing the effectiveness of the coil elements.

Some axial field vacuum interrupter designs, such as those disclosed in U.S. Pat. Nos. 4,675,483, 4,871,888, 4,982,059 and 5,313,030, have attempted to reduce or eliminate the radially extending portions of the coils by using cylindrical coils having a plurality of angled slots, the angled slots defining a plurality of helically extending current carrying arms. The helical arms typically result in a current path that is not as effective in producing a large axial field as are purely circumferentially extending coil elements. The helical current path extends significantly in the axial direction behind the contact, in effect moving the coil farther from the contact. Both types of prior art electrode assembly designs typically have several pieces, thereby imposing high parts and construction costs.

Other axial field vacuum interrupters, such as those disclosed in U.S. Pat. Nos. 3,823,287 and 4,704,506, incorporate cylindrical coils which are spaced axially forward of a backing plate. The cylindrical coils include arcuate arms having rectangular cross sections of relatively small area, which result in high current densities and slow heat transfer through the coil arms during operation of the vacuum interrupter.

Axial magnetic field vacuum interrupters are conventionally used to interrupt currents larger than 5 kA in medium voltage systems, e.g., 3.6 to 38 kV. Typical prior art axial magnetic field vacuum interrupters do not operate satisfactorily in high continuous current (greater than 1600 A) applications for two major reasons. First, the arms of the coil add a significant length of material through which the current must flow. The arms usually have a relatively small cross-section, resulting in high current densities. The increased length and reduced cross-section cause an increased resistance which leads to heat generation in the coil. Second, heat is generated at the contact interface between the fixed and movable coil assemblies. The only means of removing this heat is by conduction through the coil structure. The increased length and reduced cross-section of conventional designs leads to high thermal resistance, which impedes the efficient removal of heat.

The most common way to solve the above-noted problems is to increase the number of arms in the coil. This has the effect of reducing the current that flows through each arm, thus reducing the heat that is generated in the coil. While reduction in arm length reduces thermal resistance, it has the undesired effect of lowering the axial magnetic field produced by the coil by reducing the current flowing through each arm. When an alternating magnetic field is passed through a conductor such as the contact plate, a countercurrent is produced in the form of eddy currents. These eddy currents produce a magnetic field that opposes the desired axial magnetic field. The resultant field may not be sufficient to maintain a diffuse arc between the contacts, resulting in a failure of the vacuum interrupter to interrupt. A solution to the eddy current problem is to cut slots in the contact face, reducing the eddy currents and the countermagnetic field. However, slots adversely effect the high voltage performance of the device.

It is therefore desirable to obtain an electrode assembly for a vacuum interrupter having a coil structure that produces a satisfactory axial magnetic field and allows the use of high continuous currents.

SUMMARY OF THE INVENTION

The present invention provides an electrode assembly for a vacuum interrupter including a contact plate connected to an electrode coil. The electrode coil includes a base for attachment to a terminal post of the vacuum interrupter and at least one arcuate arm extending from the base defining a substantially circumferential current path. The arcuate arm has a radial cross section of greater thickness adjacent the base than adjacent the contact plate.

The present invention also provides an electrode coil for an axial magnetic field vacuum interrupter including a generally disk-shaped based for attachment to a terminal post of the vacuum interrupter, and at least one arcuate arm extending from the base defining a substantially circumferential current path, wherein the arcuate arm comprises more material located adjacent the base than located away from the base.

The present invention further provides a method of making an electrode coil for a vacuum interrupter, the method including the steps of providing a piece of material, forming a generally disk-shaped base from a portion of the piece of material, and removing material from another portion of the piece of material to form at least one arcuate arm extending from the generally disk-shaped base, wherein the arcuate arm comprises more material located adjacent base than located away from the base.

An object of the invention is to provide an improved electrode assembly for providing an axial magnetic field to the contact region of a vacuum interrupter.

Another object of the present invention is to provide an electrode coil for a vacuum interrupter which permits the use of higher continuous currents in axial magnetic field vacuum interrupters by increasing the cross-sectional area of the field-producing coil.

A further object of the invention is to provide an electrode coil for a vacuum interrupter that does not generate excessive resistive heat.

Another object of the invention is to provide a low cost electrode assembly for producing a magnetic field in a vacuum interrupter that includes a minimum number of component parts and is simple to fabricate.

These and other objects of the present invention will become more apparent from the following description.

DETAILED DESCRIPTION OF THE PREFERRED EMBODIMENTS

Figure 1:
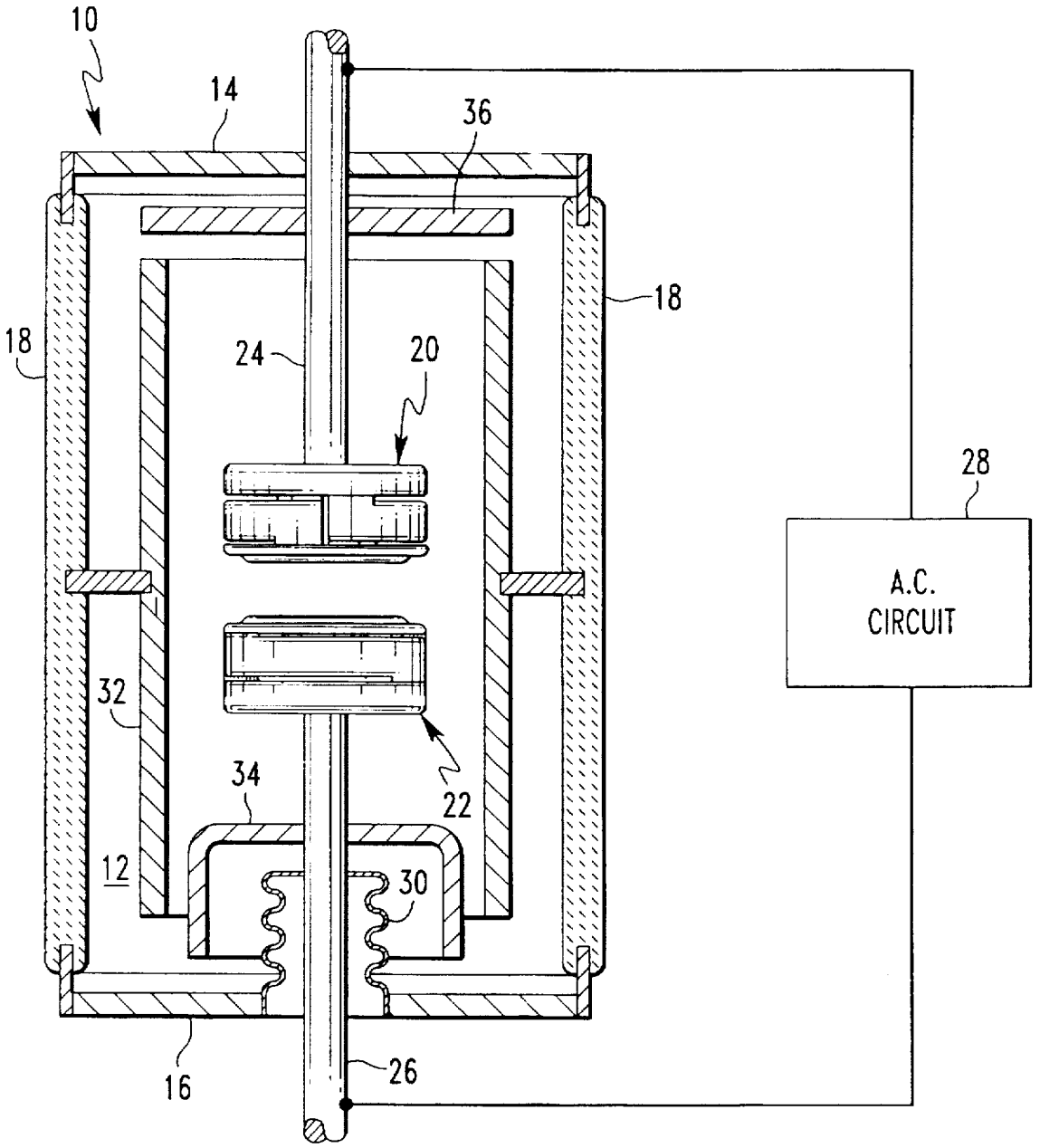
FIG. 1 shows a vacuum interrupter in which the electrode coils of the present invention may be installed.

Referring now to FIG. 1, a vacuum interrupter 10 according to an embodiment of the invention includes a vacuum envelope 12 having spaced conducting end caps 14 and 16 joined by a tubular insulating casing 18. First and second electrode assemblies 20 and 22 define a common longitudinal axis within the vacuum envelope 12. First and second terminal posts 24 and 26 are electrically coupled to the first and second electrode assemblies 20 and 22, respectively, for coupling the first and second electrode assemblies 20 and 22 to an AC circuit 28. A mechanism, such as a bellows assembly 30, permits axial movement of at least one of the electrode assemblies between an open circuit position and a closed circuit position (not shown). A vapor shield 32 that is either electrically isolated from the electrode assemblies 20 and 22, or connected to only one of the electrode assemblies 20 and 22, surrounds both electrode assemblies to keep metal vapors from collecting on the insulating casing 18. A bellows vapor shield 34 keeps metal vapors off the bellows assembly 30 and end cap 16, while an additional vapor shield 36 protects the other end cap 14.

Figure 2:
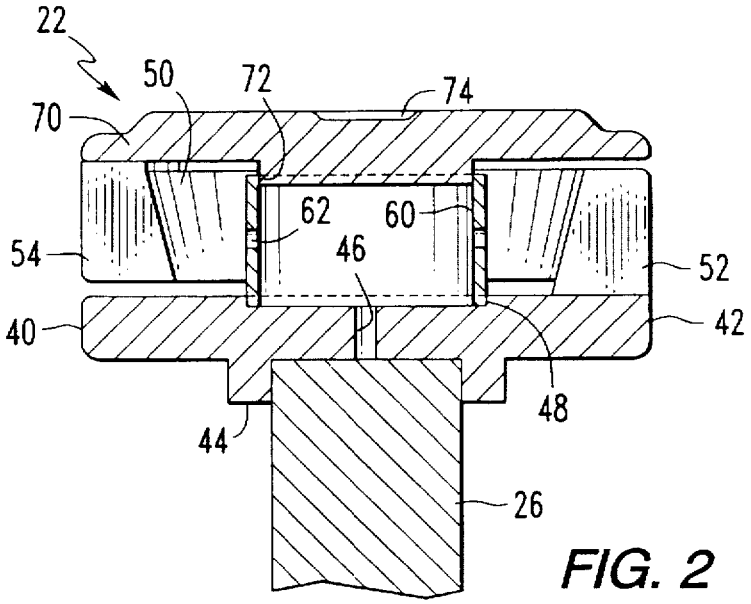
Fig. 2 is a sectional view of an electrode assembly in accordance with an embodiment of the present invention.

FIG. 2 is a sectional view of an electrode assembly 22 of the present invention. The electrode assembly 22 includes a generally cup-shaped electrode coil 40 having a base 42 attached to a terminal post 26 by means of an annular flange 44. The base 42 is generally disk shaped, and includes a hole 46 passing through the center thereof which prevents gas entrapment. The base 42 may be attached to the terminal post 26 by any suitable means such as welding, brazing, soldering or press fitting, with brazing being particularly preferred.

As shown in FIG. 2, the electrode coil 40 includes an arcuate arm 50 which extends almost 180° around the circumference of the electrode coil 40. A post 52 connects the base 42 to the arcuate arm 50. Another post 54 extends from the arcuate arm 50 and is attached to a contact plate 70. The base 42, arcuate arm 50 and posts 52, 54 are preferably fabricated from a single piece of material and subsequently attached to the contact plate 70, as more fully described below. The material of these components comprises any material having sufficient electrical conductivity and heat transfer capability. Metals such as copper and Cu/Cr composites are suitable.

A sleeve 60 fits within a circular indentation 48 in the base 42. A hole 62 is preferably provided through the sleeve 60 in order to prevent gas from being trapped in the sleeve. The sleeve 60 is preferably made of stainless steel. The contact plate 70 is attached to the sleeve 60 by a ciruclar raised portion 72 which fits inside the sleeve 60. The contact plate 70 optionally includes a dimple 74.

Figure 3:
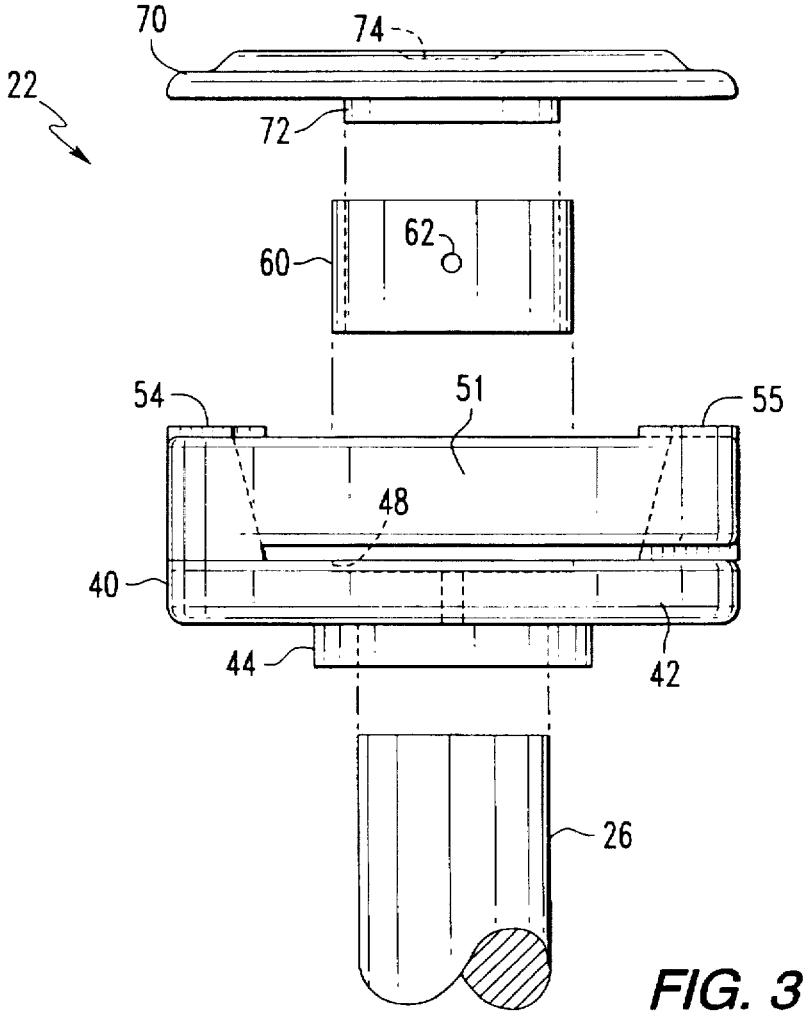
FIG. 3 is an exploded view of the components of an electrode assembly in accordance with an embodiment of the present invention.

As shown most clearly in FIG. 3, the electrode assembly 22 includes relatively few component parts that are relatively easy to assemble. The contact plate 70 is preferably attached to the electrode coil 40 by means of the sleeve 60. The sleeve 60 is attached to the circular raised portion 72 of the contact plate 70 by any suitable means such as welding, brazing or press fitting, with brazing being preferred. The sleeve 60 fits within the circular opening 48 of the base 42 and is secured thereto by means such as welding, brazing or press fitting, with brazing being preferred. The electrode assembly 22 is attached to the terminal post 26 by, for example, welding, brazing or press fitting.

As described more fully below in connection with FIGS. 4–6, the electrode coil 40 includes at least one arcuate arm extending at least partially around the circumference of the electrode coil. Each arcuate coil has posts for attachment to the base 42 of the electrode coil and the contact plate 70. In the embodiment shown in FIGS. 2 and 3, the electrode coil 40 includes two arcuate arms 50 and 51, with each arcuate arm extending almost 180° around the circumference of the electrode coil. The arcuate arm 50 includes a post 54 which connects to the contact plate 70, while the arcuate arm 51 includes a post 55 which connects to the plate 70. The posts 54 and 55 are attached to the contact plate 70 by any suitable means such as welding or brazing, with brazing being preferred. Once assembled, the electrode coil 40 provides a circumferential current path between the terminal post 26 and contact plate 70.

Figure 5:
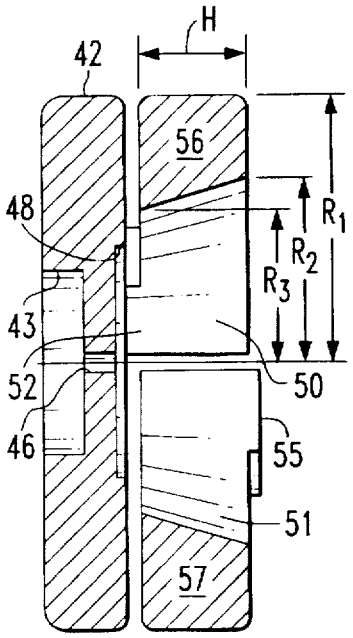
FIG. 5 is a sectional view taken through Section 5—5 of the electrode coil of FIG. 7.
Figure 4:
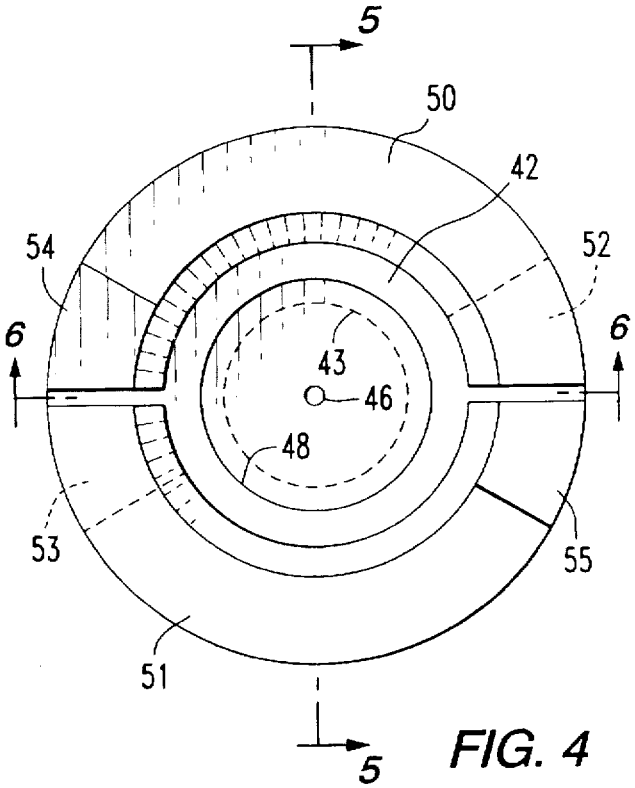
FIG. 4 is an end view of an axial magnetic field producing coil including two coil arms having trapezoidal cross-sections in accordance with an embodiment of the present invention.
Figure 6:
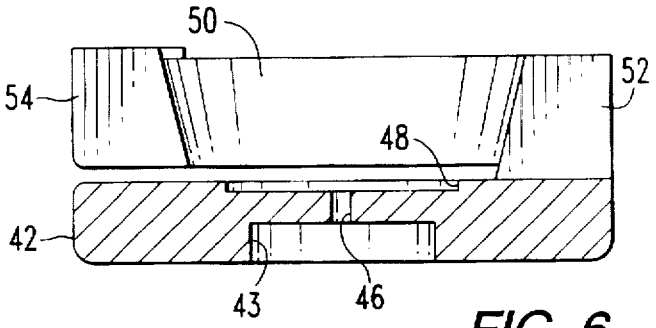
FIG. 6 is a sectional view taken through Section 6—6 of the electrode coil of FIG. 7.

FIGS. 4–6 illustrate an electrode coil in accordance with an embodiment of the present invention. The electrode coil includes a base 42 having a circular opening 43 therein for connection to a terminal post (not shown) of a vacuum interrupter. The base 42 preferably includes a circular indentation 48 for accepting a support sleeve (not shown) similar to the sleeve 60 shown in FIGS. 2 and 3. The generally disk-shaped base 42 may include a hole 46 passing through the center thereof.

In the embodiment shown in FIGS. 4–6, the electrode coil includes two arcuate arms 50 and 51, each of which has a substantially uniform radius of curvature and extends almost 180° around the circumference of the coil to provide a circumferential current path. While two arcuate coils are shown in FIGS. 4–6, it is to be understood that any suitable number of arcuate arms may be used. For example, a single arcuate arm extending almost 360° around the circumference of the coil may be used. Alternatively, more than two arcuate arms may be used, provided that the arms are capable of generating a sufficient axial magnetic field during operation of the coil. Furthermore, while the arcuate arms shown in FIGS. 4–6 have a substantially uniform radius of curvature, other configurations such as spiral arms may be used.

The arcuate arm 50 is connected to the base 42 of the coil by a post 52. Another post 54 extends from the arcuate arm 50 for connection with a contact plate (not shown), in a manner similar to that shown in FIG. 2. The arcuate coil 51 likewise includes a post 53 connected to the base 42 and a post 55 for connection to the contact plate.

As shown most clearly in FIG. 5, each of the arcuate arms 50 and 51 has a non-rectangular radial cross section 56 and 57, respectively. For example, the cross section 56 of the arcuate arm 50 has a cross sectional area defined by the height H of the arm extending in the axial direction of the coil, and the dimensions $R_1$, $R_2$ and $R_3$, extending in a radial direction from the central axis of the coil. The radius $R_1$ represents the outer radius of the arcuate arm 50. The inner surface of the arcuate arm 50 tapers radially inward from the radius $R_2$ to the radius $R_3$. The cross section 56 shown in FIG. 5 is of substantially trapezoidal shape having an area defined by the formula:

$$A=H\times(R_1-(R_2+R_3)/2).$$

As shown in FIGS. 4–6, the use of an inner radius $R_3$ adjacent to the base 42 of the electrode coil that is smaller than the inner radius $R_2$ adjacent the contact plate (not shown) provides a non-rectangular radial cross section for each of the arcuate arms 50 and 51. For a given dimension H, the area of the cross section 56 shown in FIG. 5 can be increased, by decreasing the length of the inner radius $R_3$ below the length of the inner $R_2$ radius. The relative lengths of the inner radii $R_2$ and $R_3$ are preferably controlled in order to provide a tapered inner surface of the arcuate arm which extends at an angle of from about 1 to about 45 degrees with respect to the central axis of the electrode coil. The angle of the taper more preferably is from about 15 to about 20 degrees.

By providing more material closer to the base plate 42 than the contact plate, the arcuate arms 50 and 51 provide several advantages. In accordance with the present invention, the current handling capacity of the electrode coil is increased while maintaining the ability to generate a sufficient axial magnetic field. For example, if the area of the cross section 56 shown in FIG. 5 is increased by 22% in comparison with the area of a similar arcuate arm having a rectangular cross section with no taper, the current handling capacity of the coil is increased by 13% with only minimal reduction in the axial magnetic field, e.g., by less than about 5%, as determined by finite element analysis.

Figure 7:
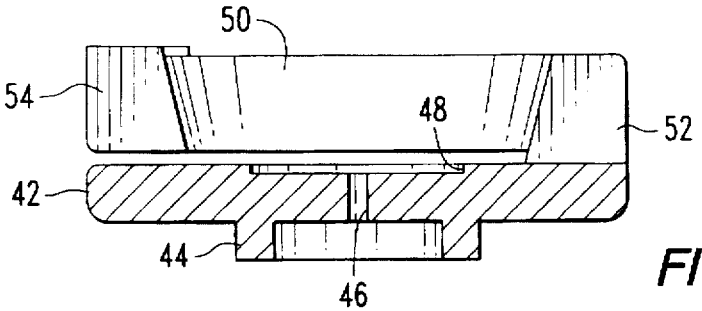
FIG. 7 is a sectional view of an axial magnetic field producing coil including coil arms having trapezoidal cross-sections in accordance with another embodiment of the present invention.

The embodiment shown in FIG. 7 is similar to the embodiment shown in FIGS. 4–6, with the exception that the base 42 of the electrode coil is provided with a raised flange 44 instead of a circular opening 43 for connection to the terminal post (not shown).

While the arcuate arms shown in the embodiments of FIGS. 4–7 have generally trapezoidal cross-sections, other configurations are possible in accordance with the present invention, provided that the arcuate arms have more material adjacent to the base 42 of the coil than adjacent to the contact plate. For example, while the inner surfaces of the arcuate coils shown in FIGS. 4–7 taper inward along a straight line from the inner radius $R_2$ to the inner radius $R_3$, a curved or segmented line may be used. Furthermore, while the outer radius $R_1$ shown in FIGS. 4–7 is substantially uniform along the axial height H of the arcuate arms, the outer surface of the arcuate arms may be tapered in addition to, or in place of, the tapered inner surface of the arms.

The following examples are intended to illustrate various aspects of the present invention, and are not intended to limit the scope thereof.

EXAMPLE 1

Coils including arcuate arms having rectangular cross-sections similar to those described in U.S. application Ser. No. 08/340,578, which has been abandoned in favor of U.S. application Ser. No. 08/801,321, the disclosure of which is incorporated by reference herein, were produced and tested in comparison with coils having trapezoidal cross-sections similar to those shown in FIGS. 4–6. The rectangular cross-sections had an area of 0.2485 square inch, while the trapezoidal cross-sections had an area of 0.3045 square inch. Tests were performed in a 38 kV breaker, which was installed in a standard enclosure. A temperature rise test conducted at 2,000 A continuous current showed that for the coils with arms of rectangular cross-section, the resulting temperature rise was above the ANSI acceptable limit of 65° C., by 5° C. When the coils having arms of trapezoidal cross-section were subjected to the same test, the temperature rise was below the acceptable limit, by 9° C.

EXAMPLE 2

Vacuum interrupters constructed in a similar as shown in FIG. 1 were equipped with axial magnetic field electrode assemblies as shown in FIGS. 2–3. The vacuum interrupters were installed in a 38 kV breaker and tested. The vacuum interrupters successfully passed 38 kV 40 kA inductive switching and a 38 kV capacitor switching to ANSI standards.

In accordance with the present invention, an axial magnetic field producing coil is provided which increases continuous current capability without adversely effecting high voltage performance or the interruption ability of the vacuum interrupter. The use of arcuate coils having relatively large cross-sections of controlled shape increases the heat transfer capabilities of the coils while generating a satisfactory axial magnetic field. Furthermore, the axial magnetic field producing coils of the present invention reduce machining time and cost by reducing the amount of material that must be removed during fabrication.

While the present invention has been described in terms of certain embodiments, various adaptations, modifications and changes will be apparent to those skilled in the art, and such adaptations, modifications and changes are intended to be within the scope of the present invention, as set forth in the following claims.

What is claimed is:

1. An electrode assembly for a vacuum interrupter comprising:

a contact plate defining an axial direction of the electrode assembly; and an electrode coil connected to the contact plate including a base for attachment to a terminal post of the vacuum interrupter and at least one arcuate arm between the base and the contact plate extending along a curved path in a plane substantially perpendicular to the axial direction of the electrode assembly, wherein the at least one arcuate arm has a radial cross section measured from the axial direction of the electrode assembly which tapers radially inward from a portion of the arcuate arm adjacent the contact plate toward a portion of the arcuate arm adjacent the base.

2. The electrode assembly of claim 1, wherein the assembly comprises a post connecting the at least one arcuate arm to the base, the base is generally disk-shaped, and the post extends in a direction substantially perpendicular to a plane defined by the generally disk-shaped base.

3. The electrode assembly of claim 2, wherein the at least one arcuate arm has an outer radius substantially equal to an outer radius of the generally disk-shaped base.

4. The electrode assembly of claim 1, wherein the assembly comprises a post connecting the at least one arcuate arm to the contact plate, the contact plate is generally disk-shaped and the post extends in a direction substantially perpendicular to a plane defined by the generally disk-shaped contact plate.

5. The electrode assembly of claim 4, wherein the at least one arcuate arm has an outer radius substantially equal to an outer radius of the generally disk-shaped contact plate.

6. The electrode assembly of claim 1, wherein the at least one arcuate arm includes an inner surface that tapers radially inward from a portion of the arcuate arm adjacent the contact plate toward a portion of the arcuate arm adjacent the base.

7. The electrode assembly of claim 6, wherein the inner surface of the at least one arcuate arm tapers radially inward along a substantially straight line.

8. The electrode assembly of claim 7, wherein the inner surface of the at least one arcuate arm tapers radially inward at an angle of from about 1 to about 45 degrees from a central axis of the electrode assembly.

9. The electrode assembly of claim 1, wherein the radial cross section of the at least one arcuate arm has a substantially trapezoidal shape.

10. The electrode assembly of claim 1, wherein the electrode coil includes two of the arcuate arms and each of the arcuate arms extends almost 180° around a circumference of the electrode assembly.

11. The electrode assembly of claim 1, wherein the at least one arcuate arm extends in a plane substantially parallel to a plane defined by the base.

12. The electrode assembly of claim 1, wherein the at least one arcuate arm has a substantially uniform radius of curvature.

13. The electrode assembly of claim 1, further comprising a sleeve attached between the contact plate and the base of the electrode coil, and positioned interior of the at least one arcuate arm.

14. An electrode coil for an axial magnetic field vacuum interrupter comprising:

a generally disk-shaped base for attachment to a terminal post of the vacuum interrupter; and at least one arcuate arm connected to and offset from the base in a direction perpendicular to a plane defined by the generally disk-shaped base and extending along a curved path in a plane substantially parallel with the plane defined by the generally disk-shaped base, wherein the at least one arcuate arm has a radial cross section measured from the center of the generally disk-shaped base which tapers radially inward from a portion of the arcuate arm located away from the base toward a portion of the arcuate arm located adjacent the base.

15. The electrode coil of claim 14, wherein the electrode coil comprises a post connecting the at least one arcuate arm to the base and the post extends in a direction substantially perpendicular to the plane defined by the generally disk-shaped base.

16. The electrode coil of claim 15, wherein the at least one arcuate arm has an outer radius substantially equal to an outer radius of the generally disk-shaped base.

17. The electrode coil of claim 14, wherein the at least one arcuate arm includes an inner surface that tapers radially inward from a portion of the arcuate arm located away from the base toward a portion of the arcuate arm located adjacent the base.

18. The electrode coil of claim 17, wherein the inner surface of the at least one arcuate arm tapers radially inward along a substantially straight line.

19. The electrode coil of claim 18, wherein the inner surface of the at least one arcuate arm tapers radially inward at an angle of from about 1 to about 45 degrees from a central axis of the electrode coil.

20. The electrode coil of claim 14, wherein the radial cross section of the at least one arcuate arm has a substantially trapezoidal shape.

21. The electrode coil of claim 14, wherein the coil includes two of the arcuate arms and each of the arcuate arms extends almost 180° around a circumference of the electrode assembly.

22. The electrode coil of claim 14, wherein the at least one arcuate has a substantially uniform radius of curvature.

23. A method of making an electrode coil for a vacuum interrupter, the method comprising:

providing a piece of electrically conductive material;

forming a generally disk-shaped base from a portion of the piece of electrically conductive material; and removing material from another portion of the piece of electrically conductive material to form at least one arcuate arm connected to and offset from the base in a direction perpendicular to a plane defined by the generally disk-shaped base and extending along a curved path in a plane substantially parallel with the plane defined by the generally disk-shaped base, wherein the at least one arcuate arm has a radial cross section measured from the center of the generally disk-shaped base which tapers radially inward from a portion of the arcuate arm located away from the base toward a portion of the arcuate arm located adjacent the base.

* * * * *